US007500831B2

(12) United States Patent
Pearce

(10) Patent No.: US 7,500,831 B2
(45) Date of Patent: Mar. 10, 2009

(54) SELF BALANCING FAN

(75) Inventor: Richard A. Pearce, Byhalia, MS (US)

(73) Assignee: Hunter Fan Company, Memphis, TN (US)

( * ) Notice: Subject to any disclaimer, the term of this patent is extended or adjusted under 35 U.S.C. 154(b) by 365 days.

(21) Appl. No.: 11/418,581

(22) Filed: May 4, 2006

(65) Prior Publication Data

US 2007/0258821 A1 Nov. 8, 2007

(51) Int. Cl.
*F04D 29/34* (2006.01)

(52) U.S. Cl. ..... 416/205; 416/5; 416/204 R; 416/207; 416/210 R; 416/246

(58) Field of Classification Search ..... 416/5, 416/204 R, 205, 207, 210 R, 246
See application file for complete search history.

(56) References Cited

U.S. PATENT DOCUMENTS 1,583,864 A * 5/1926 Tucker ..... 416/142
4,936,751 A 6/1990 Marshall
5,304,037 A 4/1994 Scofield
5,433,585 A * 7/1995 Yan ..... 416/204 R
5,464,323 A 11/1995 Scofield
5,873,701 A * 2/1999 Shiu ..... 416/205
5,954,449 A * 9/1999 Wu ..... 403/315
6,149,388 A 11/2000 Liao
6,155,786 A 12/2000 Blateri et al.
6,210,117 B1 * 4/2001 Bucher et al. ..... 416/210 R
6,382,918 B1 5/2002 Tang
6,431,834 B1 * 8/2002 Lackey et al. ..... 416/205
6,644,925 B1 11/2003 Collmar
6,863,499 B2 3/2005 Pearce

* cited by examiner

*Primary Examiner*—Igor Kershteyn
(74) *Attorney, Agent, or Firm*—Baker Donelson et al.

(57) ABSTRACT

A fan (10) is disclosed having an electric motor (13) which rotatably drives an annular array of blade irons (14) each having a blade (15) mounted thereto. Each blade iron has a motor mounting portion (21) configured to be coupled with the electric motor for rotation. The motor mounting portion has an arcuate, vertical wall (26) and a horizontal flange (27). The horizontal flange has a first mounting hole (28) and an oblong second mounting hole (29). A first mounting screw (31) having a first bushing or bearing (32) thereon passes through each first mounting hole and into a threaded mounting hole (34) in the motor (13). Similarly a second mounting screw (35) having a second bushing or bearing (36) thereon passes through each second mounting hole and into a threaded mounting hole (37) in the motor. With this configuration the blade iron can pivot relative to the motor.

23 Claims, 5 Drawing Sheets

SELF BALANCING FAN

TECHNICAL FIELD

This invention relates to fans, and specifically to a self correcting or balancing system for a fan.

BACKGROUND OF THE INVENTION

Fans, and especially ceiling fans, have become an increasingly popular supplementary means of conditioning air within both commercial and residential buildings. Notwithstanding the widespread use of ceiling fans, one continuing problem which faces ceiling fan designers is the tendency of ceiling fans to "wobble", or pivot about the point of suspension, due to fan blade imbalance, i.e., the dynamic axial center of the rotating mass of the fan blades and blade irons is not on the same axis or location as the center of the motor. Additionally, fan blade imbalance and the associated ceiling fan wobble may result from other discrepancies associated with the ceiling fan blades including variations in blade pitch angle, dihedral angle, uneven circumferential spacing between adjacent blade pairs, blade warpage and uneven radial spacing of the blades from the vertical axis of rotation. Ceiling fan wobble and the associated vibration creates undesirable noise, is visually distracting and may adversely affect the service life of the ceiling fan.

Accordingly, it is seen that a need exists for a ceiling fan which is capable of balancing itself so that it will not wobble during use. It is to the provision of such therefore that the present invention is primarily directed.

SUMMARY OF THE INVENTION

In a preferred form of the invention a fan comprises a motor, an annular array of blade irons with each blade iron being pivotally coupled to the motor, and a plurality of blades with each blade being coupled to one blade iron of the annular array of blade irons.

DETAILED DESCRIPTION

Figure 1:
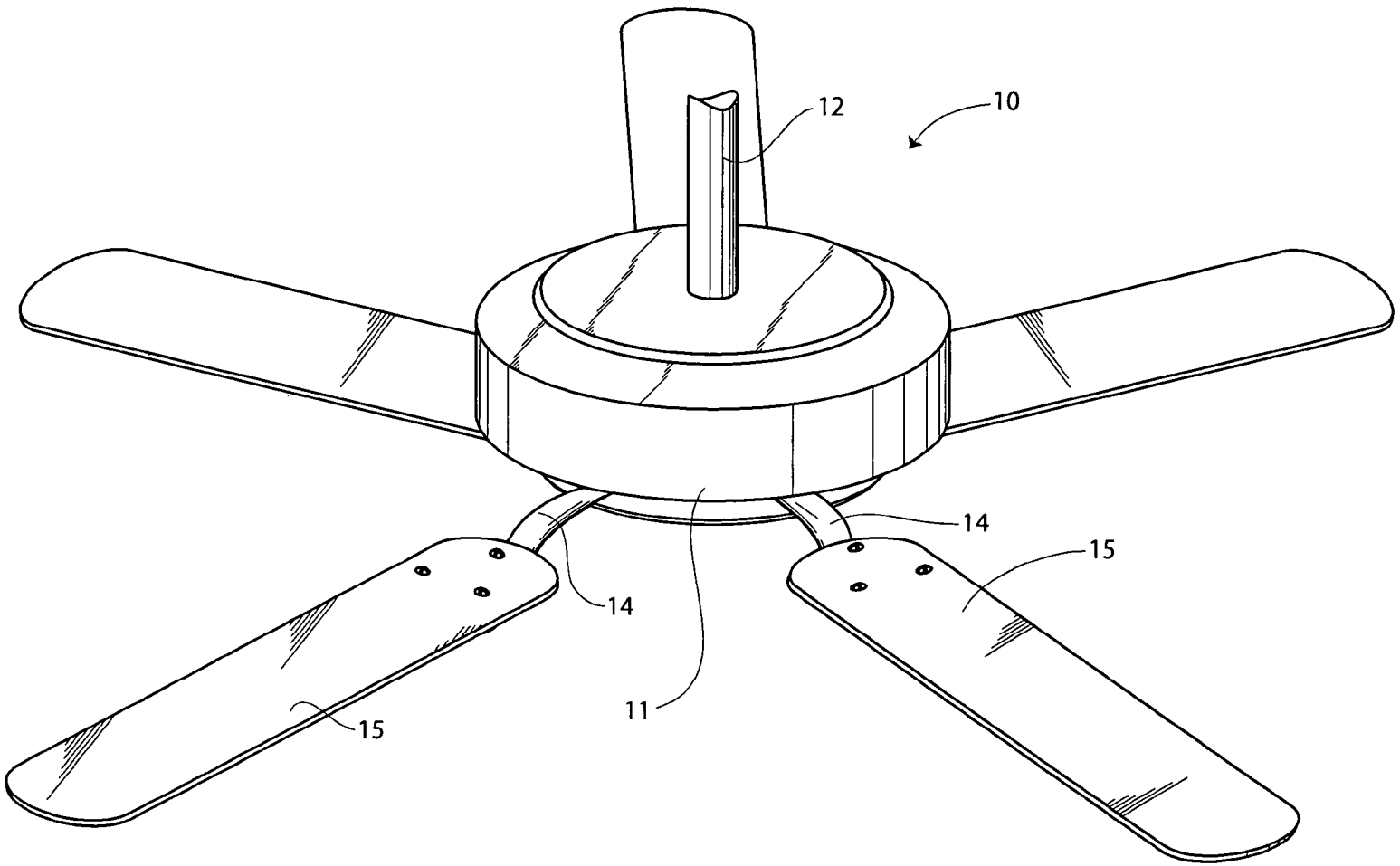
FIG. 1 is a perspective view of a fan that embodies principles of the invention in its preferred form, shown in a position mounted to a ceiling.
Figure 2:
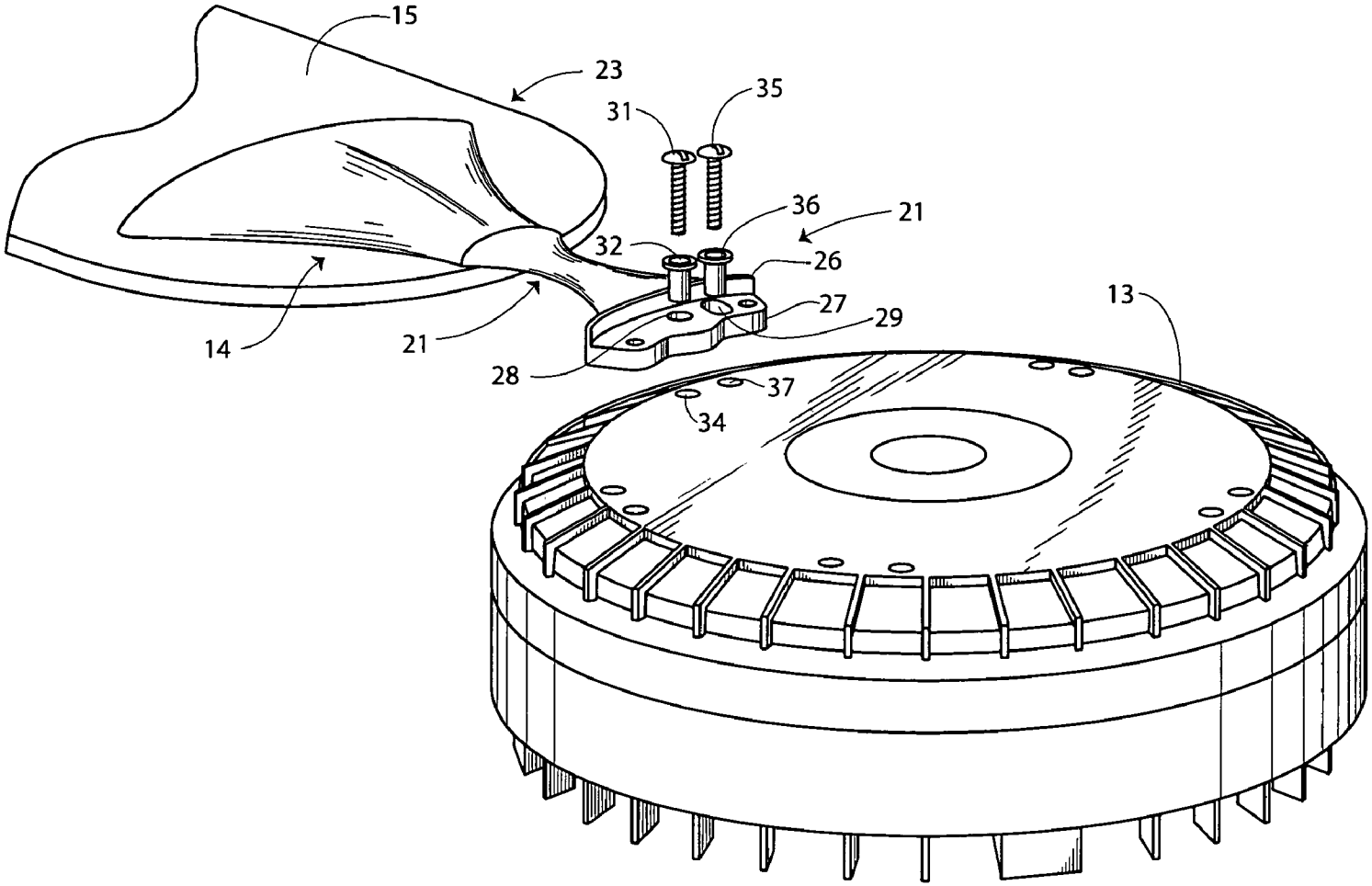
FIG. 2 is an inverted, exploded, perspective view of the motor, blade iron and a portion of the blade of the fan shown in FIG. 1.
Figure 3:
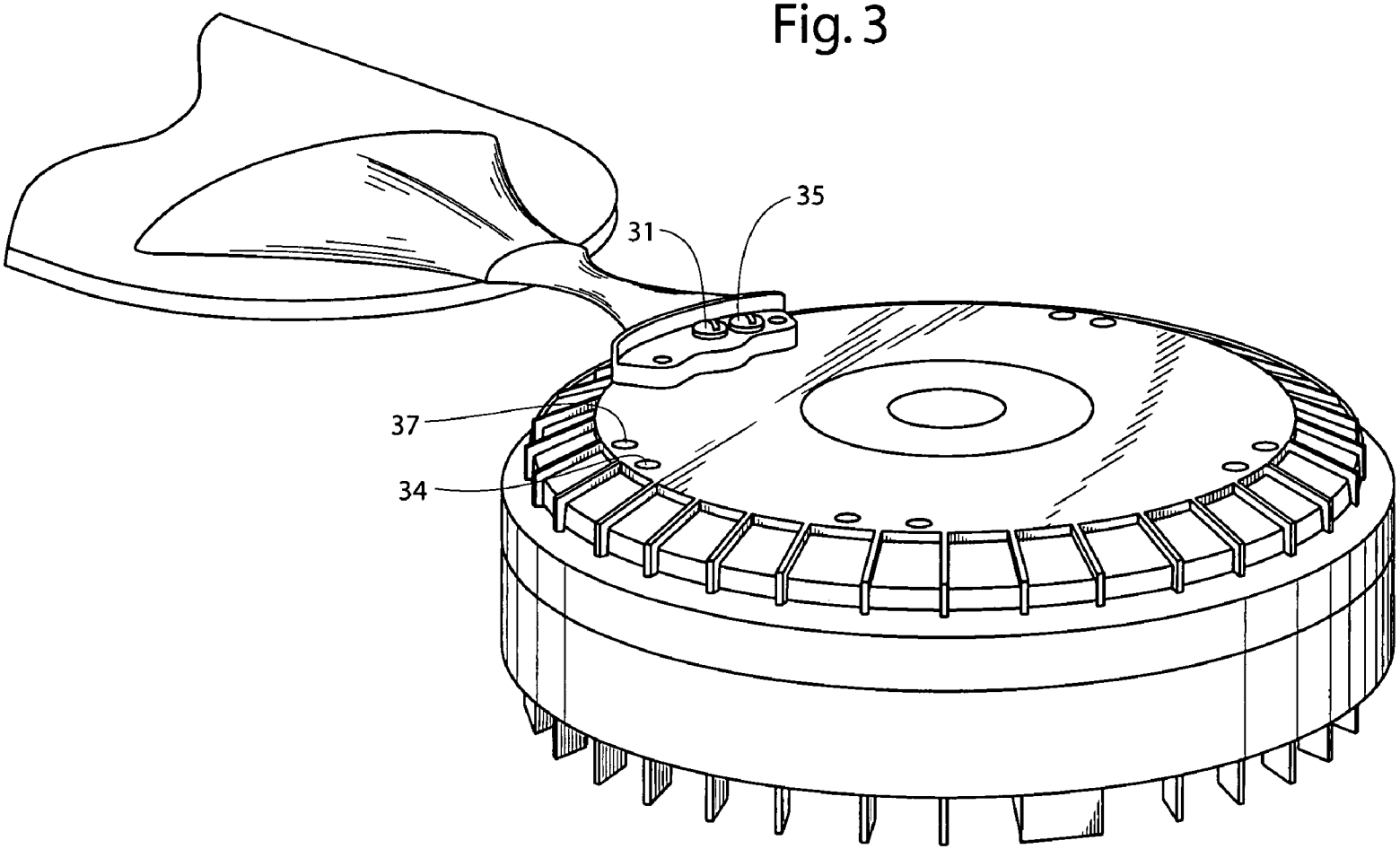
FIG. 3 is an inverted, perspective view of the a portion of the motor, blade iron and a portion of the blade of the fan shown in FIG. 1.

With reference next to the drawings, there is shown a ceiling fan 10 having a motor housing 11 suspended from an unshown ceiling by a downrod 12. An electric motor 13 is mounted within the housing 11 and connected to a source of electric power by electrical wires that extend through the downrod 12. The motor rotatably drives an annular array of mounting brackets or blade irons 14, each having a blade 15 mounted thereto. The blade irons 14 have a generally elongated configuration generally aligned along a longitudinal axis LA. The blade irons 14 are coupled to the motor generally along an annular array of radial lines RL extending radially from the center or center axis of the motor, i.e., a radial array of lines RL.

Each blade iron 14 has a motor mounting portion 21 configured to be coupled with the electric motor 13 for rotation, a neck 22, and a blade mounting portion 23. The motor mounting portion 21 has an arcuate, vertical wall 26 and a horizontal flange 27. The horizontal flange 27 has a first mounting hole 28 and an oblong second mounting hole 29. The first mounting hole 28 is located or oriented generally along blade iron longitudinal axis LA and along a motor radial lines RL. A first mounting screw 31 having a first bushing or bearing 32 thereon passes through each first mounting hole 28 and into a threaded mounting hole 34 in the motor 13. Similarly a second mounting screw 35 having a second bushing or bearing 36 thereon passes through each second mounting hole 29 and into a threaded mounting hole 37 in the motor 13. The size and configuration of the second mounting screw 35 and bushing 36 is smaller than the oblong mounting hole 29 to allow limited pivotal movement of the blade iron 14 relative to the motor 13, the limit of pivotal movement being defined by the size of the hole relative to the bushing. It should be understood that the second mounting screw 35 is not mandatory as a portion of the blade iron mounting portion may be configured to limit pivotal movement by contacting the motor upon extended pivotal movement.

In use, the downrod 12 is coupled to the ceiling with the motor housing 11 coupled to the opposite end of the downrod with the blade irons 14 pivotally mounted to the motor 13. Each blade 15 is mounted to a corresponding blade iron 14 through mounting screws in conventional fashion.

Figure 4:
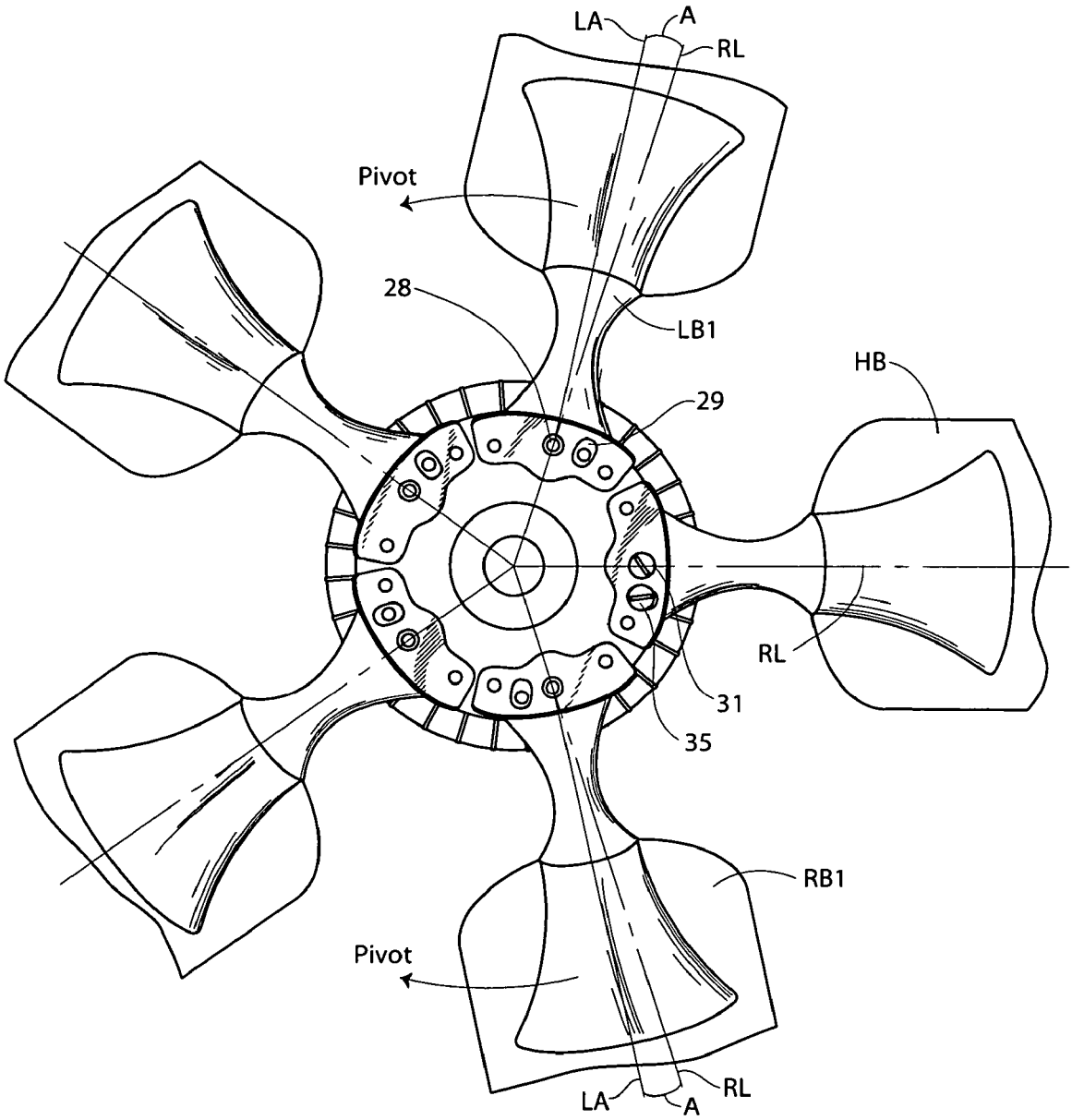
FIG. 4 is a bottom view of the motor and portions of the blade irons and blades of the fan shown in FIG. 1.

Once the motor 13 is electrically energized its rotation causes the blade irons and associated blades to rotate about the general center or central axis of the motor. As best illustrated in FIG. 4, the rotation of the blade irons may cause a blade iron and blade which is slightly heavier than the others to move the center of the mass (blade irons and blades) away from the central axis of the motor, thereby unbalancing the mass and resulting in unwanted wobble. However, with the present invention this unbalancing is counteracted by the pivotal movement of the blade irons.

The slightly heavier blade iron and blade is designated collectively in FIG. 4 as blade HB. The blade iron and blade combinations, designated herein as RBI and LBI, on either side of the heavier blade HB will inherently pivot about first mounting screw 31 in a direction away from heavier blade HB, as illustrated by the leftward tilting of blade irons RBI and LBI, and the resulting increase in the gap between the blade iron flanges 27 between the heavier blade HB and its adjacent blade irons, as best seen in FIG. 4. This is also illustrated by the angle A shown between the blade iron longitudinal axis LA and the blade iron associated radial line RL with regard to blade irons RBI and LBI. This pivoting of the remaining blade irons RBI and LBI, it should be noted that the other two blade iron combinations may also pivot to a degree to compensate for the heavier blade HB, offsets or reduces the unbalancing caused by the heavier blade HB so that the center of the rotating mass is brought into general alignment with the central axis of the motor, thereby eliminating or reducing the wobbling effect. As such, the pivotal movement of the blade irons tends to create or move a dynamic axial center of the rotating mass of the fan blades and blade irons along or into the approximate vicinity as the axis of the motor.

It should be understood that the mounting screws 31, 35 may be in the form of permanent posts forming a portion of the blade irons and pivotally mounted to the motor, rather than the removable screws shown in the preferred embodiment. Similarly, other alternatives to the threaded screws shown in the preferred embodiment can be utilized as an alternative, such as bolts, headed posts, rivets, or other similar items.

Figure 5:
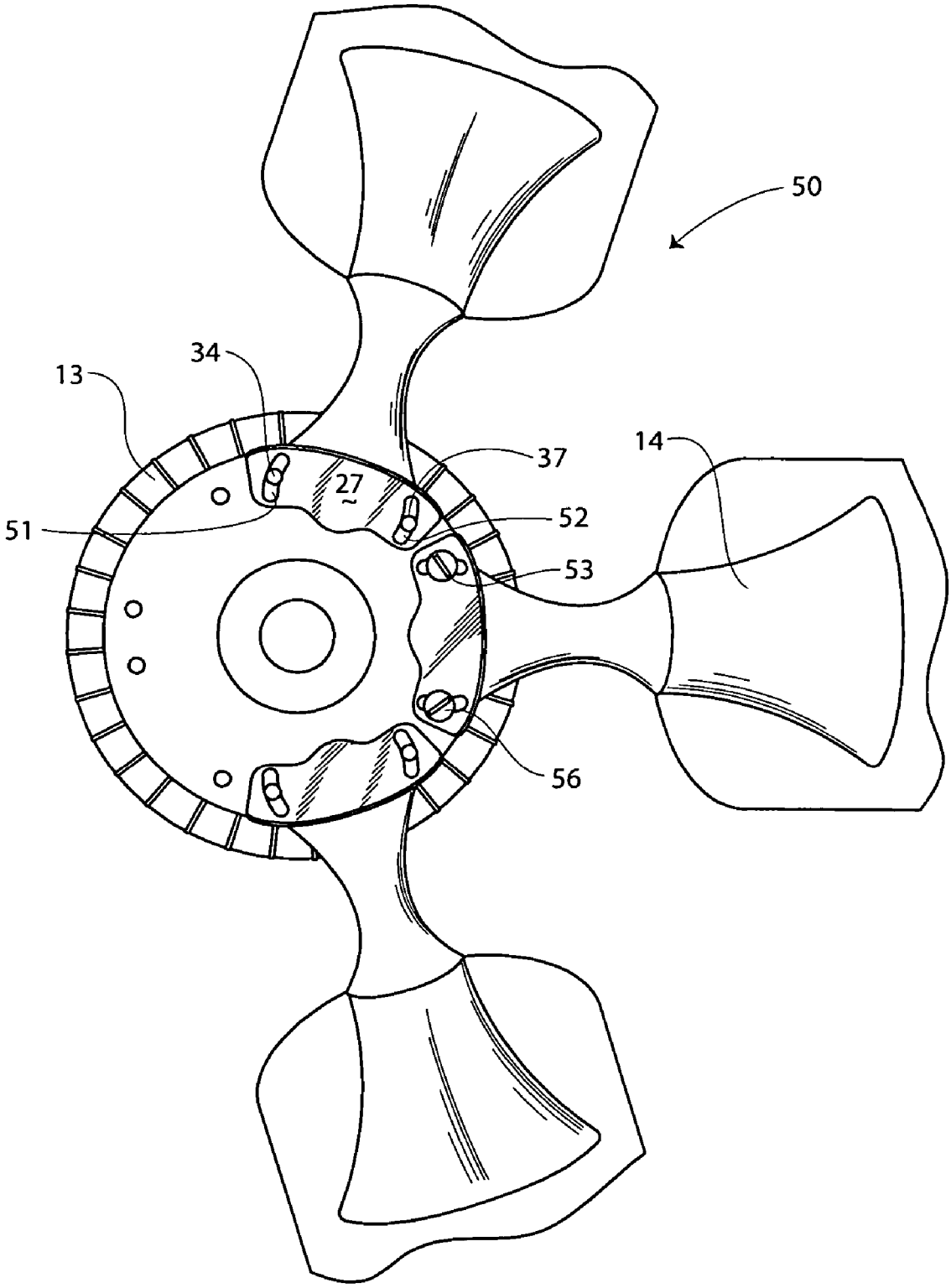
FIG. 5 is an inverted, perspective view of a fan in another preferred form of the invention.

With reference next to FIG. 5, there is shown a fan 50 in another preferred form of the invention. Here, the blade iron is essentially of the same construction as previously shown except for the positioning of the mounting holes. The fan 50 has a first elongated mounting hole 51 and a second elongated mounting hole 52. A first mounting screw 53 and bushing are positioned within the first mounting hole 51 and threaded into the motor mounting hole 34. Similarly, a second mounting screw 56 and bushing are positioned within the second mounting hole 52 and threaded into the motor mounting hole 37. As such, the first and second mounting screws are positioned adjacent opposite ends of said blade iron flange. It should be noted that the designations for the threaded mounting holes of the motor have been changed to accommodate the different positioning of the blade iron mounting holes of this embodiment.

In use, the blade iron is allowed to pivot relative to the motor through the sliding engagement of the blade iron through the bushings 54 and 57 and elongated mounting holes 51 and 52. As such, the blade iron is allowed to pivot relative to the motor as previously described in reference to FIGS. 1-4.

It should be understood that the present invention may be utilized with other types of fans and is not intended to be limited to ceiling fans.

It thus is seen that an improved fan blade iron mounting system is now provided which enables the fan to be automatically balanced to restrict wobbling. While this invention has been described in detail with particular references to the preferred embodiments thereof, it should be understood that many modifications, additions and deletions, in addition to those expressly recited, may be made thereto without departure from the spirit and scope of the invention as set forth in the following claims.

The invention claimed is:

1. A fan comprising, a motor having an annular array of blade iron first mounting holes;

an annular array of blade irons mounted to said motor, each said blade iron having a mounting portion with a longitudinal axis extending generally along the length of said blade iron and a first mounting post coupled to said motor first mounting hole coupling said blade iron to said motor, said first mounting post being positioned along said longitudinal axis and generally perpendicular to said longitudinal axis, said first mounting post allowing pivotal movement of said blade iron about said first mounting post in a lateral direction relative to a line extending radially from said motor; and a plurality of blades, each blade being coupled to one said blade iron of said annular array of blade irons.

2. The fan of claim 1 wherein said blade iron mounting portion includes a generally centrally oriented first mounting hole configured to receive said first mounting post.

3. The fan of claim 2 further comprising a first bearing mounted about said first mounting post.

4. The fan of claim 2 wherein each said blade iron includes a second mounting hole extending through said mounting portion and a second mounting post extending through said second mounting hole, said second mounting hole being configured larger than said second mounting post to allow limited pivotal movement of said blade iron about said first mounting post.

5. The fan of claim 4 further comprising a first bearing mounted about said first mounting cost and a second bearing mounted about said second mounting post.

6. A fan comprising, a motor having a plurality of laterally extending radial lines;

an annular array of blade irons, each said blade iron being pivotally coupled to said motor for lateral, pivotal movement relative to said motor laterally extending radial line passing longitudinally through said blade iron, and a plurality of blades, each blade being coupled to one said blade iron of said annular array of blade irons.

7. The fan of claim 6 wherein each said blade iron includes a first mounting post pivotally coupling said blade iron to said motor.

8. The fan of claim 6 wherein said first mounting post is aligned generally along a longitudinal axis extending along said blade iron.

9. The fan of claim 7 wherein said first mounting post comprises a first threaded post extending into said motor and a first bearing mounted about said first mounting post.

10. The fan of claim 7 wherein each said blade iron includes a second mounting post which limits the pivotal movement of said blade iron about said first mounting post.

11. The fan of claim 10 further comprising a first bearing mounted about said first mounting post and a second bearing mounted about said second mounting post.

12. The fan of claim 7 further comprising a second mounting post, and wherein said first and second mounting posts are positioned adjacent opposite ends of a mounting portion of said blade iron.

13. A fan comprising, a motor;

an annular array of blade irons mounted to said motor along a plurality of radial lines oriented relative to said motor, each said blade iron having a longitudinal line extending along the length of said blade iron, each said blade iron having a mounting portion with a mounting post aligned along said radial line and said longitudinal line associated with said blade iron, said mounting post coupling said blade iron to said motor, said mounting post, mounting portion and mounting hole being configured to allow lateral pivotal movement of said blade iron about said mounting post and relative to said radial line associated with said blade iron; and a plurality of blades, each blade being coupled to one said blade iron of said annular array of blade irons.

14. The fan of claim 13 wherein said first mounting post comprises a first threaded post extending into said motor and a first bearing mounted about said first mounting post.

15. The fan of claim 13 wherein each said blade iron includes a second mounting post which limits the pivotal movement of said blade iron about said first mounting post.

16. The fan of claim 15 further comprising a bearing mounted about said second mounting post.

17. A fan comprising, a motor, said motor having a center point;

an annular array of blade irons;

mounting means for mounting said blade irons to said motor to enable pivotal movement of each said blade iron in a lateral direction relative to a radial line extending from said center point of said motor and through said blade iron, and a plurality of blades, each blade being coupled to one said blade iron of said annular array of blade irons.

18. The fan of claim 17 wherein each said blade iron includes a first mounting post pivotally coupling said blade iron to said motor.

19. The fan of claim 18 wherein said first mounting post is aligned generally along a longitudinal axis extending along said blade iron.

20. The fan of claim 18 wherein said first mounting post comprises a first threaded post extending into said motor and a first bearing mounted about said first mounting post.

21. The fan of claim 18 wherein each said blade iron includes a second mounting post which limits the pivotal movement of said blade iron about said first mounting post.

22. The fan of claim 21 further comprising a bearing mounted about said second mounting post.

23. The fan of claim 18 further comprising a second mounting post, and wherein said first and second mounting posts are positioned adjacent opposite ends of a mounting portion of said blade iron.

* * * * *